US008376116B2

(12) United States Patent
Robinson et al.

(10) Patent No.: US 8,376,116 B2
(45) Date of Patent: Feb. 19, 2013

(54) NOTE STORAGE AND/OR DISPENSING APPARATUS

(75) Inventors: Christopher Robinson, Oldham (GB); David Bellis, Oldham (GB)

(73) Assignee: Innovative Technology Limited, Oldham (GB)

( * ) Notice: Subject to any disclaimer, the term of this patent is extended or adjusted under 35 U.S.C. 154(b) by 0 days.

(21) Appl. No.: 13/097,280

(22) Filed: Apr. 29, 2011

(65) Prior Publication Data

US 2012/0103754 A1 May 3, 2012

(30) Foreign Application Priority Data

Nov. 1, 2008 (GB) ..... 0820089.1

(51) Int. Cl.
*G07F 7/04* (2006.01)

(52) U.S. Cl. ..... 194/206

(58) Field of Classification Search ..... 194/206, 194/344, 350, 353; 209/534; 235/379; 902/9, 902/10, 11, 12, 13; 242/334, 471; 221/71, 221/72

See application file for complete search history.

(56) References Cited

U.S. PATENT DOCUMENTS

| | | | | |
|---|---|---|---|---|
| 5,680,935 | A * | 10/1997 | Mistander et al. | 209/534 |
| 6,179,457 | B1 * | 1/2001 | Simonotti et al. | 235/375 |
| 6,371,473 | B1 * | 4/2002 | Saltsov et al. | 271/3.01 |
| 7,051,926 | B2 * | 5/2006 | Saltsov et al. | 235/379 |
| 2008/0265013 | A1 * | 10/2008 | Saltsov et al. | 232/1 D |

FOREIGN PATENT DOCUMENTS

| | | |
|---|---|---|
| DE | 19629900 | 1/1998 |
| EP | 0735513 | 9/2001 |
| EP | 1243537 | 9/2002 |
| EP | 1321408 | 6/2003 |
| WO | WO 99/28870 | 6/1999 |
| WO | WO 2004/081883 | 9/2004 |
| WO | WO 2007/101621 | 9/2007 |
| WO | WO 2008/087095 | 7/2008 |

* cited by examiner

*Primary Examiner* — Mark Beauchaine
(74) *Attorney, Agent, or Firm* — Woodard, Emhardt, Moriarty, McNett & Henry LLP

(57) ABSTRACT

Apparatus for storing/dispensing notes such as bills of monetary value, wherein the notes are stored between opposed webs wound onto drums, and notes having different characteristics may be stored on the same drum.

26 Claims, 5 Drawing Sheets

NOTE STORAGE AND/OR DISPENSING APPARATUS

REFERENCE TO RELATED APPLICATIONS

This application is a continuation of PCT/GB2009/002577, filed 29 Oct. 2009, which is hereby incorporated by reference. This application claims priority from Patent Application No. GB 0820089.1, filed 1 Nov. 2008, which is hereby incorporated by reference.

The invention to which this application relates is apparatus of the type which can be used to receive, store and/or dispense bills, notes or cards, which typically have a monetary value in a particular currency.

Although the following description refers almost exclusively to use of apparatus with notes having a monetary value, it will be appreciated by persons skilled in the art that the present invention can be used with other items.

It is known to provide apparatus to allow the retrieval of banknotes therefrom, such as an automatic transaction machine (ATM) via which user's can access their accounts to obtain cash. As such apparatus does not allow replenishment by the users, it is necessary to keep restocking the machine with notes which is time-consuming and involves security risks while the apparatus is open during the restocking operation.

It is therefore desirable to allow the infeed of banknotes from users as well as outfeed thereof. Indeed it is known to provide apparatus such as that described in U.S. Pat. No. 6,296,242 in the name of CashCode Company Inc, which also allows the storage and dispensing of banknotes via a user, wherein the notes are stored on reels according to their denomination to avoid the wrong types of notes being issued on subsequent request by the user.

However, such apparatus is necessarily bulky to incorporate the multiple reels required for the corresponding denominations. As such it is not possible to incorporate the same into equipment such as gambling machines, due to the limited space available inside such equipment. In addition, such apparatus is expensive due in part to the number and complexity of mechanical components required.

An aim of the present invention is to provide apparatus which is more compact and/or efficient than that of the prior art.

In an aspect of the invention there is provided note storage and/or dispensing apparatus, said apparatus including:

- at least one aperture to allow notes to be received by and/or dispensed to a user;
- at least first and second rotatable drums;
- the notes being stored between webs wound onto at least one of said drums;
- characterised in that processing means are provided for determining one or more characteristics of the notes to allow notes having differing characteristics to be stored on the same drum.

Typically said webs are opposed webs, with one lying on either side of the note held therebetween.

Thus notes of different values can be stored on the drums in a mixed arrangement, and indeed different types of note or notes such as Pounds or Euros can be received by the apparatus or dispensed to the user.

In one embodiment the processing means determines any or any combination of the length, width, denomination and/or other characteristics of the notes.

In one embodiment one or more of the drums and/or webs is provided with indication means to allow the processing means to determine the size and/or relative location of the notes.

In one embodiment the indication means includes any or any combination of barcodes, numeric codes, spaced-apart holes, daisy wheels, and/or the like.

In one embodiment the processing means stores the characteristics and/or relative location of notes stored in the apparatus in memory means.

Typically the provision of the indication means allows the notes to be stored at any position along a web. Thus the notes can be stored end-to-end to minimise the space used by the same, or they could be stored in predetermined spaced-apart positions.

In one embodiment the apparatus is provided with communication means. Typically the communication means is able to determine the availability of funds in a user's account.

In one embodiment the communication means allows the exchange rate for different currencies to be determined. This allows the apparatus to exchange one type of currency for another e.g. Pounds for Euros according to the exchange rate.

In one embodiment notes can be overlapped or stacked on the webs. For example, two notes can be stacked one on top of each other between the webs to allow quicker payout of the same i.e. two at a time. This is of particular use when providing change, as for example, two sets of two one dollar notes can be dispensed in change for a five dollar note, rather than four dispensations of a one dollar note.

In one embodiment, a first web is wound between first and second drums, the first web being opposed substantially along the length thereof by at least a further web.

Typically a second web is wound between the first drum and a third drum, and a third web is wound between the second drum and a fourth drum, the second and third webs opposing different portions of the first web.

Typically the first web is the transaction web, and the second and third webs are cover webs.

Typically the first drum is a transaction drum, the second drum is an indexing drum, and the third and fourth drums are cover drums.

In one embodiment the webs are made from a polyester film such as Mylar®. The webs ensure that the notes stay flat during movement thereof.

In one embodiment the apparatus is provided with a diverter mechanism which is moveable between a transaction configuration and an indexing configuration.

Typically the diverter mechanism is positioned between the aperture, and in the vicinity of the location where the second and third webs converge.

Typically, in the transaction configuration the diverter mechanism allows the apparatus to receive and/or dispense notes.

In one embodiment notes may be fed into the apparatus via the aperture and stored between webs which are wound onto the transaction drum.

Typically drive means are provided to rotate the transaction drum and wind the opposed webs thereonto or thereoff.

Typically the drive means is provided with an electric motor although it will be appreciated that other motor means could be used.

In one embodiment, the transaction drum may be rotated in the opposite direction to unwind the opposed webs therefrom and dispense notes via the aperture.

Typically the apparatus is provided with tensioning means to ensure that the webs remain under tension and do not become slack.

Thus when the transaction drum unwinds the opposed webs, the tensioning means ensures that the other drums take up the slack in the webs.

In one embodiment each drum is provided with a shaft. Typically the shafts are interlinked via gears. Typically the gears are driven by the drive means.

In one embodiment the indexing drum and cover drums are each provided with tensioning means in the form of a constant tension spring. Typically the springs are mounted on the shafts inside the drums and provide a biasing force to the drums to maintain tension on the respective webs. Typically the springs are pre-tensioned.

In one embodiment the torque of the springs inside the cover drums is less than the torque of the spring inside the indexing drum. Typically the torque of the springs inside the cover drums is around a third of the torque of the spring inside the indexing drum.

Typically, in the indexing configuration the diverter mechanism allows the apparatus to index notes between the first and second drums.

Thus as the drums are rotated notes are maintained in their relative positions on the transaction web as the transaction web is wound between the transaction drum and the indexing drum.

In one embodiment the drums are rotated faster in the indexing configuration than in the transaction configuration, typically around four times faster.

It will be appreciated that the transaction drum can be driven in either rotational direction to access a note at a particular position.

Thus if a user inserts a large denomination note and requires small denomination notes in return, the apparatus configures the diverter mechanism into the transaction configuration so the note can be accepted and stored on a suitable empty position between webs which are wound onto the transaction drum. The apparatus then configures the diverter mechanism into the indexing configuration so that the apparatus can move the webs between the transaction drum and indexing drum to the appropriate position to allow access to a low denomination note previously stored in the apparatus. The apparatus then configures the diverter mechanism back into the transaction configuration and the transaction drum is unwound to dispense the note.

In one embodiment the apparatus can be used in conjunction with note validation apparatus.

In one embodiment the processing means is able to reorganise the positions of the notes on the reels when the apparatus is not in use by a user. Typically the notes are reorganised into groups of commonly used denominations, such that speed of access to the same and dispensation is improved for the user.

Typically during the reorganisation operation, a note is taken from the webs, placed in an escrow location while the webs are rotated to the desired position, then retrieved from the escrow location and placed in the desired position on the transaction web.

In one embodiment the escrow location can be a location in the note validation apparatus.

In one embodiment the diverter means includes two pairs of rollers. Typically one pair of rollers is used to guide the transaction web. Typically each of the rollers of the other pair is used to guide the respective cover webs.

In one embodiment one of the rollers guiding a cover web is located in a slot and is moved along the slot to move the diverter mechanism between the transaction and indexing configurations.

Typically the slot-located roller is positioned to allow access to the rollers guiding the transaction web when in the transaction configuration, and allow notes to be released from the transaction web. Typically when the diverter mechanism is moved to the indexing configuration, the roller is moved closer to the other roller of the pairs, such that the transaction web rollers are substantially inaccessible to external notes, and notes inside the apparatus are maintained in their position on the transaction web.

In one embodiment the rollers have a diameter of around 5-10 mm. As the rollers are relatively small a sharp bend is created in the webs being guided by the same, such that the notes are easily released therefrom.

In one embodiment the apparatus can be provided with a stacker into which notes can be stored. Thus if the webs cannot receive any more notes, they can be dispensed into a stacker rather than preventing operation of the apparatus, and an engineer can easily remove or replace the same in due course.

In one embodiment the processing means adapts through use such that the frequently used denominations tend to be stored on the webs and less used denominations tend to be stored in the stacker. In addition, frequently used denominations or combinations of the same may be stored close together to improve access times to the same.

In one embodiment the apparatus allows reception and/dispensation of any or any combination of bills, notes, cards, cheques, vouchers, tickets, and/or the like.

In one embodiment notes from the stacker can be loaded onto the webs.

In a further aspect of the invention, there is provided a method of storing and/or dispensing notes, including the steps of:

- inserting notes into apparatus via an aperture;
- storing the notes between opposed webs wound onto rotatable drums;
- determining one or more characteristics of the notes via processing means;
- characterised by storing notes having differing characteristics on the same drum.

In one embodiment the size and/or relative location of the notes is determined according to indication means provided on one or more of the drums and/or webs.

In one embodiment the processing means stores the characteristics and/or relative location of notes stored in the apparatus in memory means.

In one embodiment the notes are stored end-to-end to minimise the space used by the same In a further embodiment the notes are stored in predetermined spaced-apart positions.

In one embodiment one of the drums is rotated by a motor, and the other drums maintain a constant tension on their respective webs via constant tension springs.

In one embodiment the notes are reorganised on the opposed webs when the apparatus is not in use to optimise space usage of the same.

In one embodiment a diverter mechanism is provided which is moveable between a transaction configuration to allow pay-in or pay-out of notes, and an indexing configuration to allow transport of the notes between the drums.

In one embodiment the notes are transferable between the drums such that on request, the notes can be selectively dispensed to a user via the aperture.

Specific embodiments of the invention are now described wherein.

Figure 1:
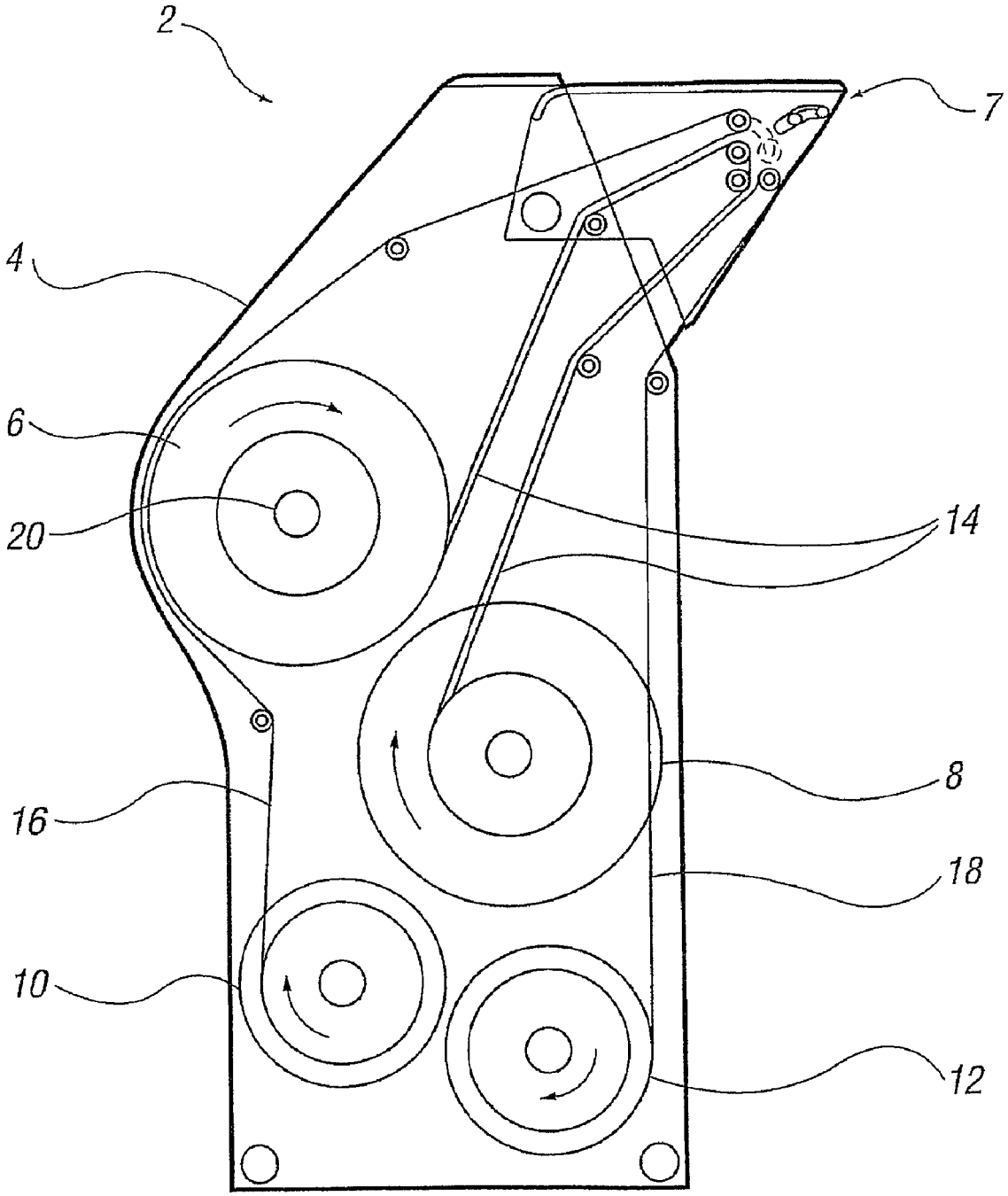
FIG. 1 illustrates a schematic side view of a note storage and/or dispensing apparatus in accordance with an embodiment of the invention.
Figure 2:
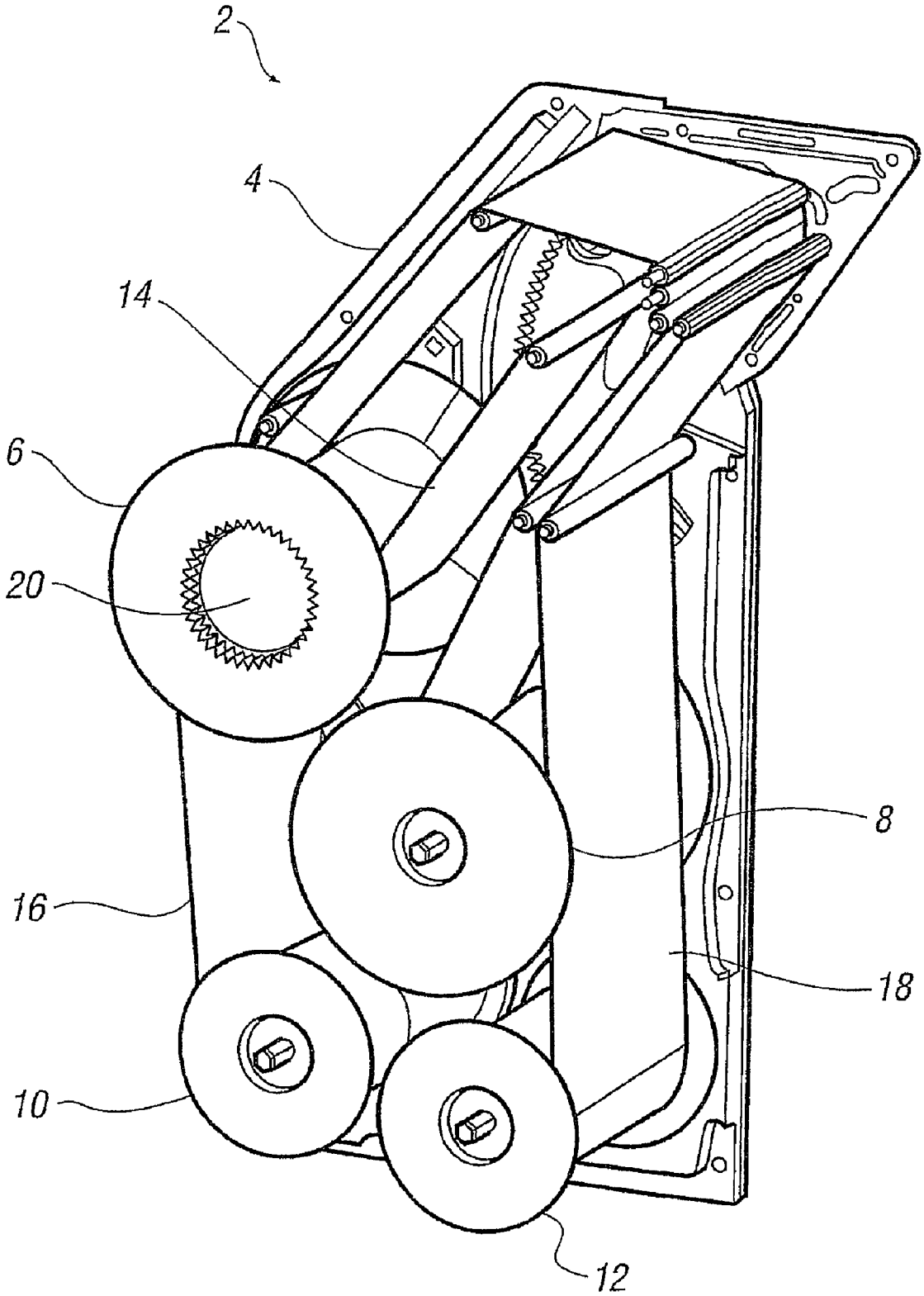
FIG. 2 illustrates an isometric cutaway view of the note storage and/or dispensing apparatus.

With reference to FIGS. 1-2, there is illustrated a note storage and/or dispensing apparatus 2 comprising a housing 4 into which notes may be fed and/or dispensed via aperture 7.

The apparatus includes a transaction drum 6, an indexing drum 8, and respective cover drums 10, 12.

A transaction web 14 is wound between the transaction drum 6 and indexing drum, and is opposed substantially along the length thereof by respective cover webs 16, 18 wound from respective cover drums 10, 12.

A diverter mechanism is positioned adjacent the aperture 7, and includes a number of rollers around which the webs 14, 16, 18 are guided. The diverter mechanism is moveable between a transaction configuration as illustrated, and an indexing configuration.

The transaction drum 6 is provided with an electric motor 20 therein such that when a note is inserted into the apparatus via the aperture 7, the note is guided to a location between the transaction web 14 and the cover web 16 and held in position therebetween, and the motor 20 winds the opposed webs 14, 16 onto the transaction drum clockwise.

Processing means (not shown) are provided to determine the size, denomination and relative position of the notes as they are inserted into the apparatus. In this example the cover web 16 fed onto the transaction drum 6 is provided with a barcoding to allow the position of the notes to be determined.

As the transaction web 14 is wound onto the transaction drum 6, it is correspondingly unwound from the indexing drum 8. The corresponding cover webs 16, 18 are consequently unwound from and wound onto their respective cover drums 10, 12. The direction of rotation of the drums is indicated by arrows on the drums in FIG. 1.

To dispense a note the motor drives the transaction drum in the opposite direction, i.e. anticlockwise, such that a note is presented to the aperture 7 as the opposed webs 14, 16 separate via the diverter mechanism.

Figure 3A:
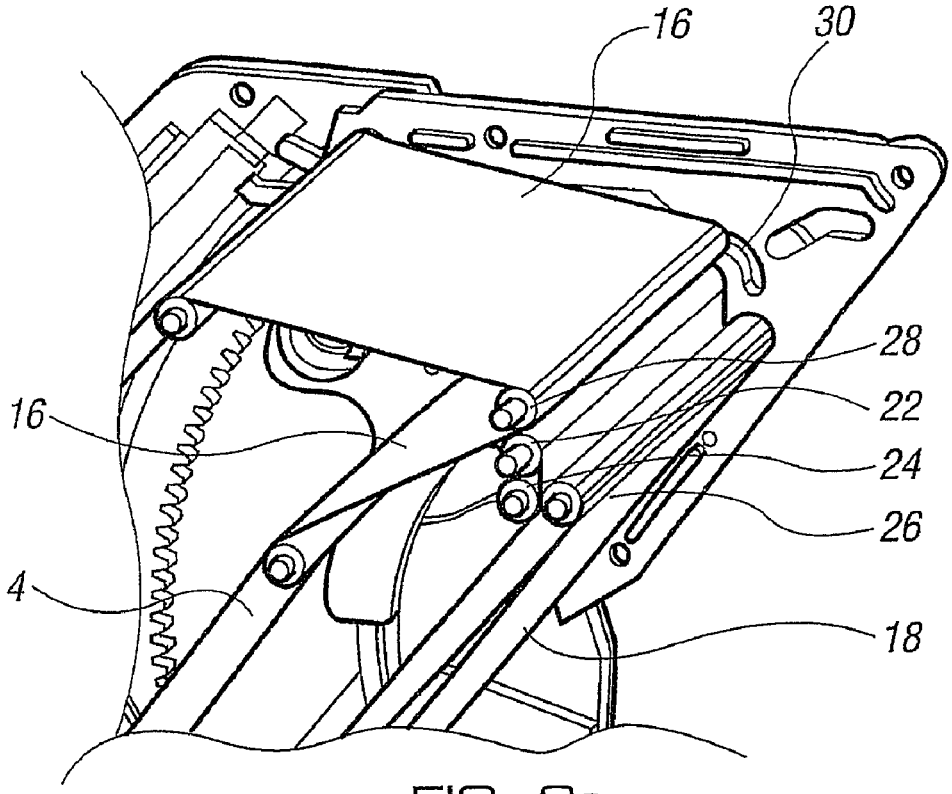
FIG. 3 illustrates a close-up isometric cutaway view of the diverter mechanism of the note storage and/or dispensing apparatus (a) in a transaction configuration; (b) in an indexing configuration.
Figure 3B:
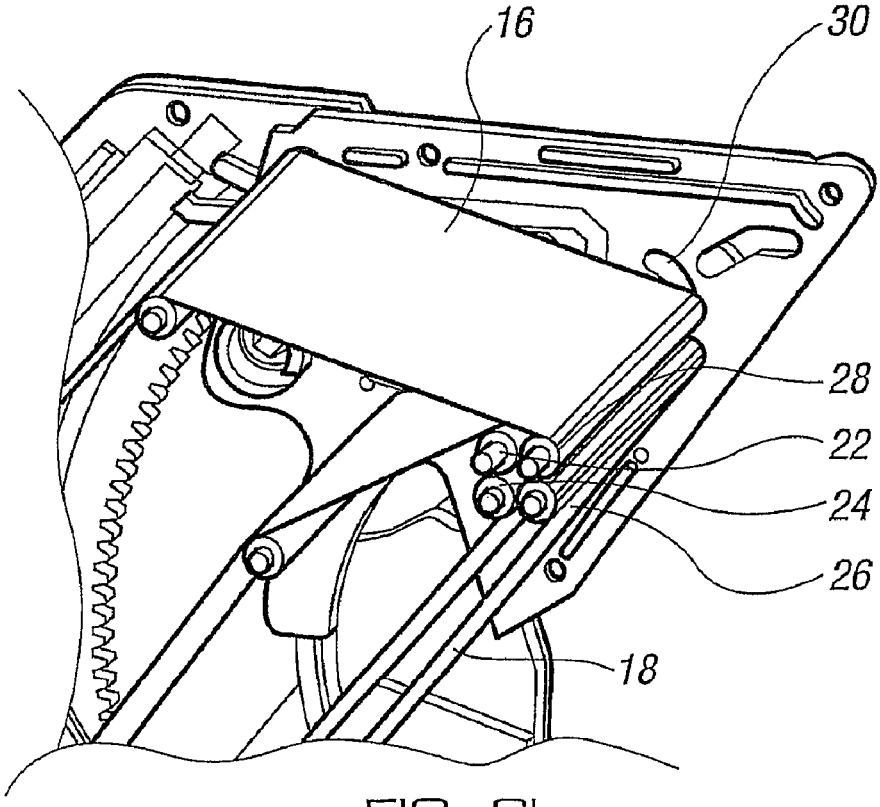

With respect to FIGS. 3*a-b*, the diverter mechanism is shown in more detail, in which a first pair of rollers 22, 24 is used to guide the transaction web 14, and each of a second pair of rollers 26, 28 is used to guide the respective cover webs 18, 16.

As the rollers are relatively small a sharp bend is created in the webs being guided by the same, such that the notes are easily released therefrom when the diverter mechanism is in the transaction configuration. As the transaction web 14 is guided around the bend, the notes, being relatively stiff, do not go around the bend and as the cover web 16, 18 is guided away from the transaction web at the bend the substantially linear notes are presented to the aperture, continuing in the general direction of the web up to the bend.

The roller 28 guiding the cover web 16 which covers the transaction web 14 on the transaction drum 20 is located in a slot 30 such that it can be moved along the slot to move the diverter mechanism between the transaction configuration as illustrated in FIG. 3*a* and the indexing configuration as illustrated in FIG. 3*b*.

Thus when the diverter mechanism is in the indexing configuration, the moveable roller 28 is close to the other roller 26 of the pair, such that any notes being transported on the transaction web 14 are prevented from escaping through the aperture, and are guided and maintained in their relative positions on the transaction web 14 as the web is guided between the transaction drum 6 and the indexing drum 8.

Figure 4:
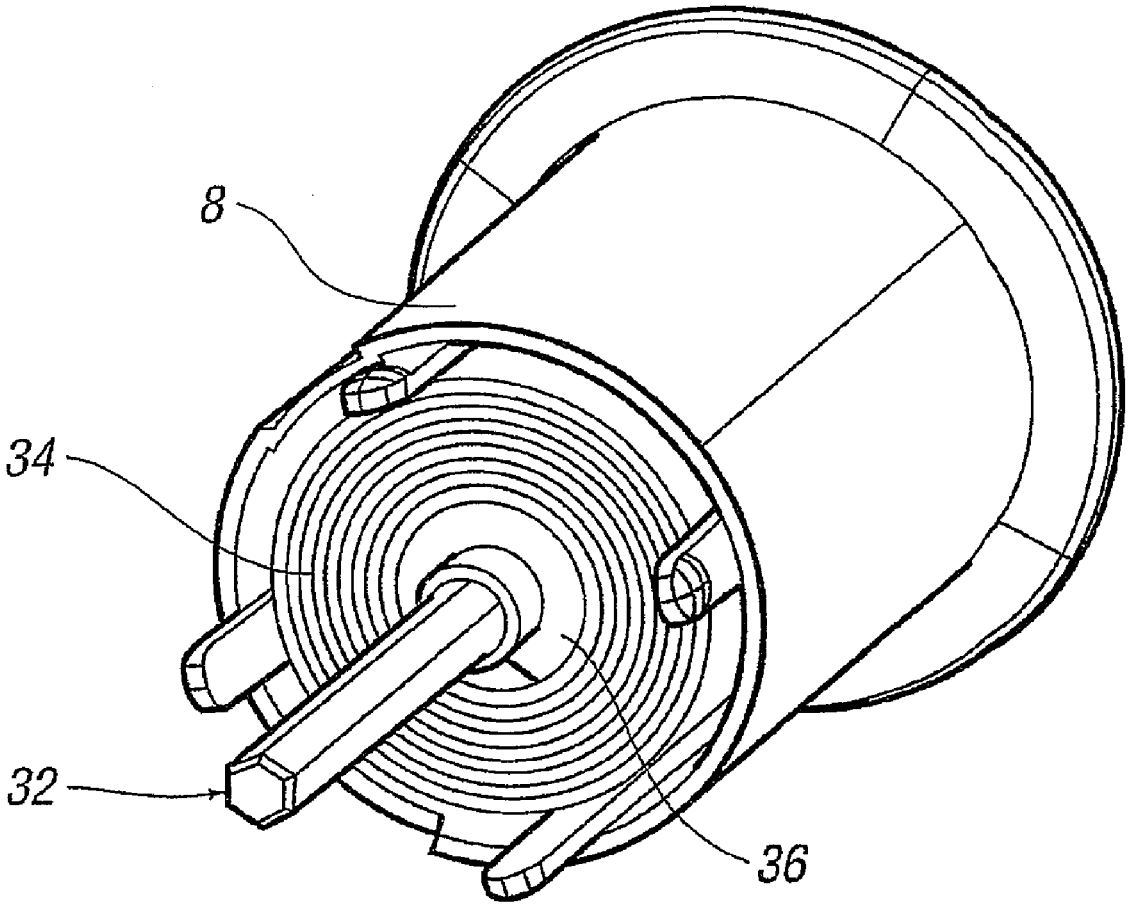
FIG. 4 illustrates an isometric cutaway view of the tensioning means of the note storage and/or dispensing apparatus.

With respect to FIG. 4 there is illustrated tensioning means which is fitted inside the indexing and cover drums 8, 10, 12 and ensure that the webs remain under tension and do not become slack as the webs are transported between the drums.

The drum 8 is provided with a shaft 32 onto which is mounted a constant tension spring 34 via an arbour 36. The spring is pre-tensioned and provides a biasing force to the drums to maintain tension on the respective webs.

Figure 5:
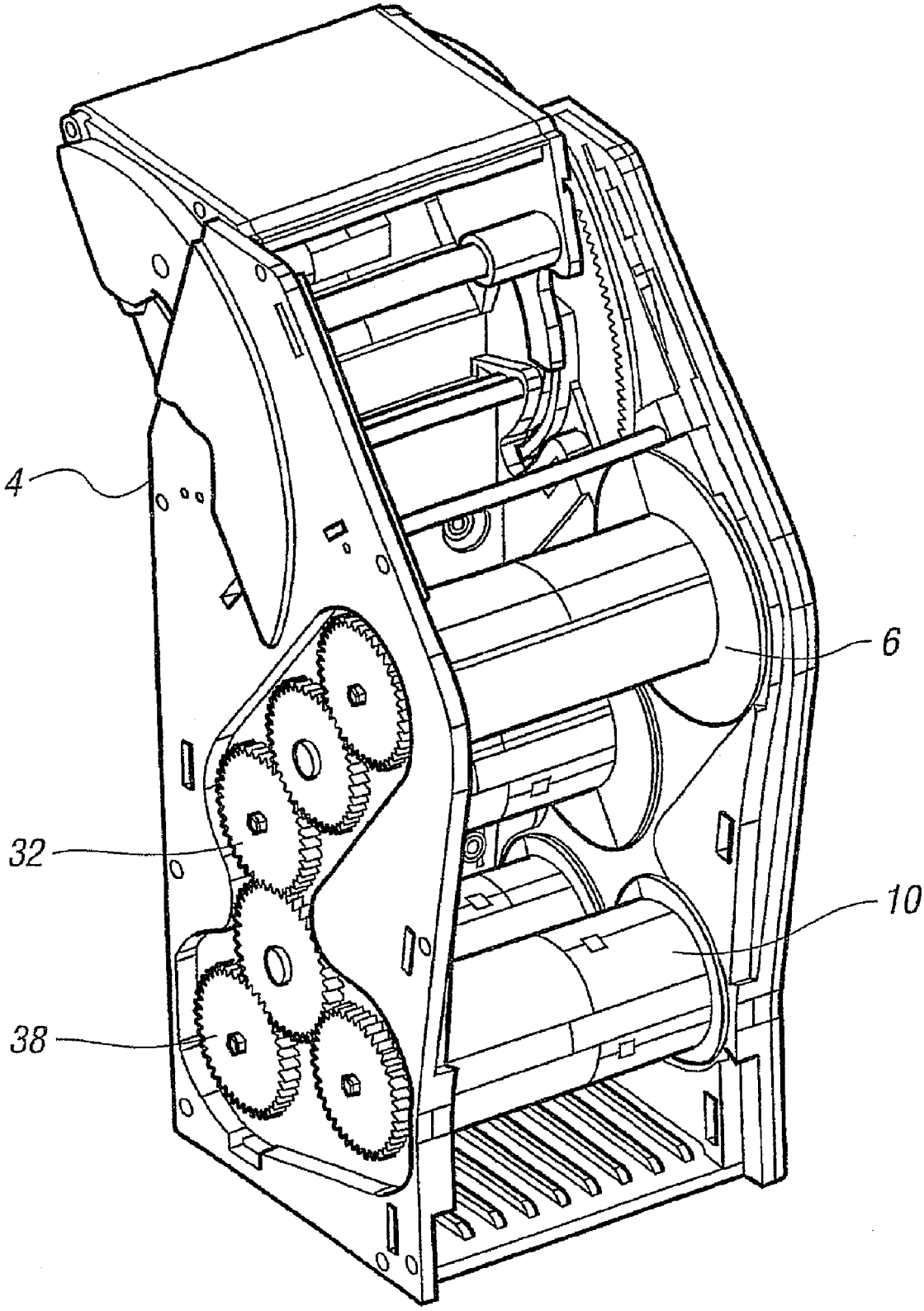
FIG. 5 illustrates a further isometric cutaway view of the note storage and/or dispensing apparatus with reference to the gears.

With respect to FIG. 5 it will be appreciated that the shafts 32 of the drums are interlinked via a gear train 38. Typically the gear connected to the transaction drum 6 is driven by the electric motor, which in turn drives the other gears connected thereto and thus the shafts of the other drums 8, 10, 12. As the shafts of the drums are connected to the drum perimeter via springs as described above, the drums maintain a constant tension on the respective webs being wound thereonto or thereoff.

Thus only one electric motor is required in the apparatus, thereby saving space. The angular positions of the indexing and cover drums are determined by the tension of the associated webs. The springs are either rotated by the web being pulled therefrom or take up slack depending on the direction of rotation.

The shafts are driven to ensure the springs stay in the same angular position (+/– five turns) relative to the drum they are mounted within. This ensures pre-tension torque is maintained over the full travel of the transaction web, which for 100 notes is around 19 metres.

Thus in use a person can feed in a variety of notes into the apparatus which are initially stored end-to-end in a mixed arrangement on the transaction drum, between opposed webs. The processing means stores the size and location of each note in memory means.

If one of the notes is dispensed to the user, this of course leaves a gap in the web, which is available for re-use by a note of the same size or smaller.

However, when the apparatus is not in use, the notes can be reorganised into an optimised arrangement, for example by grouping together notes of the same denomination, or retaining more favoured notes in more frequently accessed position as determined by the processing means. This increases the speed at which notes can be dispensed.

The reorganisation can also remove any gaps between the notes which may have been caused by re-using spaces used for large notes with small notes, to optimise the space usage of the transaction web. This allows the size of the apparatus to be minimised.

As the apparatus is significantly smaller than that of the prior art, it can be used in gambling machines and the like, or other equipment where space for installing such apparatus is limited. In addition, the apparatus is relatively cheap due to the low number of drive components.

It will be appreciated by persons skilled in the art that the present invention may also include further additional modifications made to the device which does not affect the overall functioning of the device.

The invention claimed is:

1. Note storage and/or dispensing apparatus, said apparatus including:

at least one aperture to allow notes to be received by and/or dispensed to a user;

at least first and second rotatable drums;

the notes being stored between webs wound onto at least one of said drums;

processing means for determining one or more characteristics of the notes to allow notes having differing characteristics to be stored on the same drum;

diverter means are provided and are moveable between a transaction configuration to allow notes to be received and/or dispensed via the aperture, and an indexing configuration to allow notes to be indexed between the first and second drums;

the diverter means includes a pair of rollers used to guide a first web and further rollers are used to guide respective further webs and wherein at least one of the further rollers is located in a slot and is moveable along the slot to move the diverter means between the transaction and indexing configurations.

2. Apparatus according to claim 1 wherein the processing means is able to determine any or any combination of the length, width, denomination and/or other characteristics of the notes.

3. Apparatus according to claim 1 wherein one or more of the drums and/or webs is provided with indication means to allow the processing means to determine the size and/or relative location of the notes.

4. Apparatus according to claim 3 wherein the indication means includes any or any combination of barcodes, numeric codes, spaced-apart holes, daisy wheels, and/or the like to allow notes to be stored at any position along a web.

5. Apparatus according to claim 1 wherein memory means are provided to enable the processing means to store the characteristics and/or relative location of notes stored in the apparatus.

6. Apparatus according to claim 1 wherein communication means are provided such that the availability of funds in a user's account may be determined and/or one type of currency may be exchanged for another by determining the corresponding exchange rate.

7. Apparatus according to claim 1 wherein notes may be overlapped or stacked on the webs.

8. Apparatus according to claim 1 wherein a first web is wound between first and second drums, the first web being opposed substantially along the length thereof by at least a further web.

9. Apparatus according to claim 8 wherein a second web is wound between the first drum and a third drum, and a third web is wound between the second drum and a fourth drum, the second and third webs opposing different portions of the first web.

10. Apparatus according to claim 1 wherein in the transaction configuration the slot-located roller is positioned to allow access to the rollers guiding the first web thereby allowing notes to be accepted and/or released from the first web, and in the indexing configuration, the slot-located roller is closer to the further rollers, such that the rollers guiding the first web are substantially inaccessible, thereby maintaining the position of the notes with respect to the first web.

11. Apparatus according to claim 1 wherein drive means are provided to rotate at least one drum and wind the webs thereonto or thereoff.

12. Apparatus according to claim 1 wherein tensioning means are provided to ensure that the webs remain under tension and do not become slack.

13. Apparatus according to claim 12 wherein each drum is provided with a shaft, which shafts are interlinked via gears, and the tensioning means is in the form of one or more constant tension springs mounted on the shafts.

14. Apparatus according to claim 1 wherein the apparatus can be used in conjunction with note validation apparatus.

15. Apparatus according to claim 1 wherein the processing means is able to reorganise the positions of the notes when the apparatus is not in use by a user.

16. Apparatus according to claim 15 wherein a note is taken from the webs, placed in an escrow location while the webs are rotated to the desired position, then retrieved from the escrow location and placed in a new position between the webs.

17. Apparatus according to claim 1 wherein a stacker is provided into which notes can be stored from the webs and/or retrieved for loading onto the webs.

18. Apparatus according to claim 17 wherein the processing means adapts through use such that the frequently used denominations tend to be stored on the webs and less used denominations tend to be stored in the stacker.

19. Apparatus according to claim 1 wherein the processing means adapts through use such that frequently used denominations or combinations of the same tend to be stored close together to improve access times thereto.

20. A method of storing and/or dispensing notes, including the steps of:

inserting notes into apparatus via an aperture;

storing the notes between opposed webs wound onto rotatable drums;

determining one or more characteristics of the notes via processing means;

storing notes having differing characteristics on the same drum;

moving a diverter means between a transaction configuration to allow pay-in or pay-out of notes, and an indexing configuration to allow transport of the notes between the drums, the diverter means includes a pair of rollers used to guide a first web and using further rollers to guide respective further webs and wherein at least one of the further rollers is located in a slot and is moved along the slot to move the diverter means between the transaction and indexing configurations.

21. A method according to claim 20 wherein the size and/or relative location of the notes is determined according to indication means provided on one or more of the drums and/or webs.

22. A method according to claim 20 wherein the processing means stores the characteristics and/or relative location of notes stored in the apparatus in memory means.

23. A method according to claim 20 wherein the notes are stored end-to-end to minimise the space used by the same or in predetermined spaced-apart positions.

24. A method according to claim 20 wherein at least one of the drums is rotatable by a motor, and the other drums maintain a constant tension on their respective webs via constant tension springs.

25. A method according to claim 20 wherein the notes are reorganised on the opposed webs when the apparatus is not in use to optimise space usage of the same.

26. A method according to claim 20 wherein the notes are transferable between the drums such that on request, the notes can be selectively dispensed to a user via the aperture.

* * * * *

UNITED STATES PATENT AND TRADEMARK OFFICE

CERTIFICATE OF CORRECTION

PATENT NO. : 8,376,116 B2
APPLICATION NO. : 13/097280
DATED : February 19, 2013
INVENTOR(S) : Christopher Robinson et al.

It is certified that error appears in the above-identified patent and that said Letters Patent is hereby corrected as shown below:

On the Title Page

Please add the following priority data to the patent:

Item (22) PCT Filed: October 29, 2009

Item (86) PCT No.: PCT/GB2009/002577

Item (87) PCT Pub. No.: WO 2010/061160 A1

PCT Pub. Date: June 3, 2010

Signed and Sealed this
Seventh Day of May, 2013

Teresa Stanek Rea

Teresa Stanek Rea
*Acting Director of the United States Patent and Trademark Office*